United States Patent [19]

Koziol et al.

[11] Patent Number: 4,814,055

[45] Date of Patent: Mar. 21, 1989

[54] CURRENT FEEDER FOR ELECTRODES

[75] Inventors: Konrad Koziol, Röthenbach; Erich Wenk, Nuremberg, both of Fed. Rep. of Germany

[73] Assignee: Conradty GmbH & Co. Metalleletroden KG, Rothenbach, Fed. Rep. of Germany

[21] Appl. No.: 80,459

[22] Filed: Jul. 31, 1987

[30] Foreign Application Priority Data

Aug. 1, 1986 [DE] Fed. Rep. of Germany ..... 3626206

[51] Int. Cl.[4] ..... C25B 9/00; C25B 11/00

[52] U.S. Cl. ..... 204/286; 204/279; 204/280; 204/284

[58] Field of Search ..... 204/279, 286, 280, 284, 204/285

[56] References Cited

U.S. PATENT DOCUMENTS

| | | | |
|---|---|---|---|
| 4,022,679 | 5/1977 | Koziol et al. | 204/286 |
| 4,121,994 | 10/1978 | Crippen et al. | 204/286 |
| 4,149,956 | 4/1979 | Bess, Sr. et al. | 204/290 F |
| 4,391,695 | 7/1983 | Koziol et al. | 204/290 R |
| 4,460,450 | 7/1984 | Kozoil et al. | 204/290 F |

FOREIGN PATENT DOCUMENTS

| | | |
|---|---|---|
| 2031525 | 8/1973 | Fed. Rep. of Germany . |
| 3008116 | 9/1981 | Fed. Rep. of Germany . |
| 3209138 | 9/1983 | Fed. Rep. of Germany . |

*Primary Examiner*—John F. Niebling
*Assistant Examiner*—Kathryn Gorgos
*Attorney, Agent, or Firm*—Wolf, Greenfield & Sacks

[57] ABSTRACT

A current feeder to electrodes, in particular for horizontally arranged gas evolving metal anodes for electrochemical processes. The current feeder stud is provided at its lower end with a connection element of valve metal. The connection element has a receiving bore into which the lower end of the current feeder stud is inserted leaving an intermediate space with reference to the receiving bore. The stud and connection element are fixed by a cast metal intermediate core and a substantially tubular contact structure of valve metal is embedded into this core. The contact structure is connected via a plurality of weld points to the wall of the receiving bore. Moreover, the valve metal connection element is connected to the current distribution elements of the electrode by an easily separable weld construction.

28 Claims, 10 Drawing Sheets

CURRENT FEEDER FOR ELECTRODES

The invention relates to a current feeder for electrodes, in particular for gas evolving metal electrodes for electrochemical processes, such as coated titanium anodes for amalgam cells.

Such electrodes are known for example from DE-OS 3008116. They consist essentially of mutually parallel rods which are mutually spaced in a horizontal plane, the surfaces of which rods form the working surface of the electrode. In the upper region, current distribution rails and cross rails connecting these together are provided which in turn are connected to a central vertically aligned connection bushing, also of titanium. Into this connection bushing extends a vertical current feed stud. Such current feed studs consist generally of electrolytic copper and are screwed into the connection bushing. For protection from corrosion, they are provided with titanium sleeves which are sealed and secured at the upper end of the bushing via a titanium weld or seal. Such a solution is illustrated in DE-AS 2031525, FIG. 6. Such current feed studs can also however consist of a copper core which carries titanium cladding. The copper core is screwed into the connection bushing, while the titanium cladding on the upper end of the bushing is sealed and secured by means of a titanium weld, as may be seen in particular from DE-OS 1567946.

For bridging the thread clearance between screwed in copper studs and titanium bushings, it has been proposed in DE-OS 2031525 to fill in a metal alloy with a low melting point for example Wood's metal, which is liquid at the cell temperature and is intended to provide a liquid conductive contact between the studs and the bushings. Experience has however shown that as a result of evaporation of the volatile components of the alloy, and as a result of alloy formation with copper, the originally liquid alloy becomes solidified and encrusted during operation of the anode. The liquid contact originally providing a good electrical connection is thus converted into a bad highly resistant screw contact which cannot be either tightened up or removed again intact for the purpose of regeneration.

In order to achieve improved contact between the copper current feed studs and titanium connection bushing, conical threads have furthermore been employed. It has been proposed for example with graphite electrodes to use a conical thread connection with an extremely large flank angle whereby full contact without play is achieved with partially intimately contacting graphite surfaces, as described in DE-AS 1237482. With metal electrodes however, as with graphite electrodes such a practically interflowing contact cannot be stably achieved. In particular, the problem of contacting is great when differing metals are connected together as with a copper current feed stud and a titanium bushing. The intensive intimate seating of the copper stud in the titanium bushing achieved as a result of the high application torque is worsened by material flow of the contacting components in the course of time. In addition, temperature variations occurring as a result of alternating electrical loading promote gradual loosening of the contact connection as a result of the differing thermal expansions of the components.

By tightening of the screw connection, the contact can be improved. Such an operation is however not always possible during cell operation and for that reason can make disassembly of the anode from the cell necessary.

Furthermore, from DE-OS 3209138 an anode of coated valve metal is known for electrolytic recovery of metals or metal oxides in which the electrode elements are arranged vertically, while the current feed has a substantially horizontal orientation. In order to achieve low voltage drop and simultaneously relatively inexpensive and reliable construction, the current feeders and/or distributors each have a respective sleeve of box-type design of valve metal which is cast with a metal core, for example of aluminium or zinc. In the cast, core metal is embedded about a contact structure which is connected to the internal surface of the sleeve via a plurality of weld points. This contact structure is a strip of expanded metal, wire netting, an apertured sheet or the like. With this arrangement, very good results have been achieved.

The present intention is to drive the relevant amalgam cells in a manner which is as energy efficient as possible. With this manner of operation, the smallest possible gap between the titanium anode and the amalgam cathode must be set. When the anodes are connected in parallel, this arrangement necessitates uniform low and time invariant resistances of the current feed components, thus inter alia also of the current feeder. Increases of resistance in the current feeder, for example by aging of the contact, would lead inevitably to short circuits with current regulated anode operation and the small electrode spacing.

With this background, it is an object of the invention to provide a current feeder for electrodes having horizontal electrode elements which ensures very good contact with the smallest possible internal voltage drop and high operational reliability.

According to the invention, this object is achieved by a current feeder having the features of claim 1.

With the arrangement according to the invention, the connection element necessarily belongs to the current feeder. The connection between this connection element belonging to the current feeder and the electrode results from an easily separable weld construction. This concept enables the operator of the cell to separate the current feeder from the electrode in a simple manner for the purpose of recoating without the need for him to interfere with the current feeder which is sensitive with respect to its voltage drop. Furthermore, with the current feeder according to the invention, the valve metal protection of the current feed stud in the form of a titanium sleeve or titanium cladding remains continuously welded to the connection element so that the sealing problems which are otherwise usual at this connection position are reliably prevented. The arrangement according to the invention can thus be described as a whole as a "locked" current feeder.

As a result of the construction of the current feeder according to the invention, in particular as a result of the tubular contact structure embedded into the intermediate cast metal core, which structure is coupled to the connection element at a plurality of weld points, the smallest possible and, moreover, constant voltage drop is ensured, as is necessary for energy efficient operation of cells with the narrowest possible gap between anode and cathode.

Because the connection element of the current feeder according to the invention can be arbitrarily configured without changing anything in the remaining concept or interfering with the components of the current feeder, this may be immediately applied both to electrodes which are already in operation and also to electrode arrangements still to be developed.

With one electrode type currently in use, connection bushings adjacent the electrodes are provided with a receiving bore having a special thread for the respective current feed studs. In order to make these electrodes suitable for connection to the current feeder according to the invention, in a simple manner a radial through-groove can be cut in the receiving bore of the connection bushing adjacent the electrode. Into this groove, the square connection element of the current feeder according to the invention can then be fitted like a tenon block. Securing of the two parts together then takes place by means of a weld connection which is easily separable, for example by means of a cutting machine.

A square construction of the connection element of the current feeder according to the invention is also recommendable if this is employed in combination with an electrode arrangement which is likewise currently already used, in which two upper current distribution rails are provided which are mutually parallel and spaced. In this case, the square connection element of the current feeder according to the invention can be either directly inserted between these current distribution rails and welded thereto or can be mounted on respective current distribution rail connection members between which the square connection element is introduced and to which it is welded. In this connection, the connection members represent a type of disposable element which permits multiple welding of connection elements to the electrode without the components adjacent the electrode themselves being damaged or destroyed.

However, the current feeder according to the invention also permits anodes to be configured with a new current feeder structure in which the lower current feeders are arranged either in a star formation or in a rectangular grid distribution according to the length/-breadth ratio of the active surfaces of the electrode.

Finally, the current feeder according to the invention offers the possibility of being employed with a completely new configuration of current distributor construction. This is characterised in that the current distributors of the electrode are constructed as a hollow profile which in each case is filled with a cast metal and into which a contact structure is embedded which is connected to the hollow profile via a plurality of weld points and a current feed stud is connected with such a current distributor in such manner that its connection element is inserted into a recess of the hollow profile, the receiving bore of the connection element being coupled to the internal space of the hollow profile and both being filled with the cast metal. In this way, a type of integrated arrangement of current feeder and current distributor results, the components of which are connected together in a particularly good electrically conductive manner via a continuous contact structure.

By the arrangement of an intermediate cast core between the current feeder stud and the valve metal connection element with embedded contact structure, which is connected to the internal surface of the receiving bore via a plurality of weld points, there results a good electrical connection between the intermediate core metal and the connection element with the consequence of low voltage drop even with large current densities. The intimate contact which is achieved between the contact structure and the intermediate core metal remains intact over a long operational life even with large temperature fluctuations. Moreover, the contact structure improves the mechanical strength of the current feeder according to the invention and thus of the metal electrode as a whole.

The contact structure provided according to the invention can be an open construction having surfaces oriented in a plurality of directions, and surrounded by the intermediate core metal from a plurality of directions. Such an open structure is engulfed and surrounded by the liquid intermediate core metal from a plurality of directions when the metal is poured in, so that during the solidification process the intermediate core metal shrinks into multi-lateral intimate contact with the open structure. In this manner, a large area fault-free connection is ensured between the intermediate core metal and the contact structure. The problems associated with a metallurgical bond between the intermediate core metal and the bushing metal are thus completely circumvented.

The contact structure has a relatively large surface area with a small volume compared with the volume of the intermediate core metal. Thus, considerable material saving of the very expensive valve metal is achieved.

As contact structure or open construction, sleeves of expanded metal, wire netting, apertured sheets or the like may be employed which in addition can be provided with a suitable contact coating. Instead of a complete sleeve having a base member, it is also possible to employ a cylindrical sleeve and a disc-like base part which are connected together in the receiving bore. The contact structure is secured to the internal surface of the bore wall with a plurality of weld points in the receiving bore. In this way it is also possible to permit the tubular wall of the contact structure to be a right or inclined cylinder or to be corrugated. In the latter case, there results a particularly varied orientation of the surfaces of the contact structure with the consequence of particularly intimate embedding of the contact structure into the core metal.

For particularly simple mounting of the contact structure, it can be expedient if the connection element consists of two separate components at right angles to the axial direction of the receiving bore, separation plane of those parts extending in the region of the receiving base of the receiving bore, and the components being welded longitudinally to the bore, after introduction of the contact structure into the receiving bore. In this event, the contact structure can also be constructed of small rods extending in the axial direction of the receiving bore which are inserted into the receiving bore and welded in position, the two components of the connection element then being welded thereto.

As casting metal for manufacturing the intermediate core, metals are suitable which have a melting point which lies at least 500° C. lower than that of the metal of the connection element. The core metal should moreover have a substantially higher electrical conductivity than the valve metal of the connection element, for example of titanium. Having regard to these requirements, the following metals, for example, may be considered: zinc, aluminium, magnesium, tin, antimony, lead, calcium and alloys thereof as well as corresponding alloys of copper and/or silver.

According to a further development of the concept of the invention, the receiving bore of the connection element can be provided on its entire wall surface with uniformly distributed axial grooves. Moreover, in the base of the receiving bore, relatively uniformly distributed short axial blind holes can be arranged. These grooves and bores permit the cast intermediate core metal to penetrate radially to the sleeve or axially of the base of the contact structure sleeve into the connection element, whereby optimal embedding of the contact structure is enabled. In addition, as a result of the grooves, it is also ensured that the cast material cannot be released from the wall surface of the receiving bore as a result of twisting moments exerted on the electrode.

In order to achieve particularly good securing and embedding, it is furthermore of advantageous if the end of the current feeder stud extending into the receiving bore is provided with at least one radial through slot. By this means, also the core of the current feeder stud is secured against twisting. An optimum embodiment is achieved when two perpendicularly intersecting slots are provided in the lower end of the current feeder stud.

In the lower end of the current distributor core, radially extending through bores can be advantageously provided, into which the cast intermediate core metal penetrates and forms a very intimate connection which is resistant to twisting and axial displacement. It is also self evident that a combination of radial slots with radially through bores can be provided. An optimum embodiment is then achieved if on the lower end of the core of the current feeder two mutually perpendicular radial slots, and just above these two mutually perpendicularly radial through bores, are provided.

Additional effective embedding of the current feeder stud in the intermediate core can also be achieved if its wall surface extending into the receiving bore of the connection element is provided with a profiled configuration, for example thread grooves.

A further expedient construction of the invention consists in that between the core of the current feeder and the connection element there is provided a positioning and locating arrangement. With this arrangement, exact positioning of the current feeder stud relative to the connection element can be achieved during manufacture whereafter introduction of the core metal takes place. This measure has furthermore the purpose of ensuring a secure connection between the current feeder and the connection element and thus of the electrode construction even in the event of a short circuit or quasi short circuit during operation of the electrode with possible resulting overheating of the metal of the intermediate core.

In a particularly simple construction of the positioning and locating arrangement, this consists of a plurality of bolts which engage in radial blind holes in the current feeder stud and lie on the upper end of the connection element. The bolts are additionally welded to the connection element for improved securing.

A further possible construction of this arrangement consists in that a sleeve is secured to the current feeder stud and is connected to the connection element. For particularly simple adjustment of the current feeder with reference to the connection element, the sleeve is in this connection screwed onto the current feeder stud. Also in this case the sleeve can be welded to the connection element for additional securing.

The sleeve can be constructed as a cast component; it can consist of a ring from which for example three bars extend which proceed outwardly in a somewhat conical configuration and the ends of which abut the connection element, welding being additionally provided if required.

In the following, the invention will be explained in more detail on the basis of exemplary embodiments with reference to the drawings, in which:

FIG. 1 shows a current feeder 1 according to the invention which is designed for a conventional anode 2.

Figure 1:
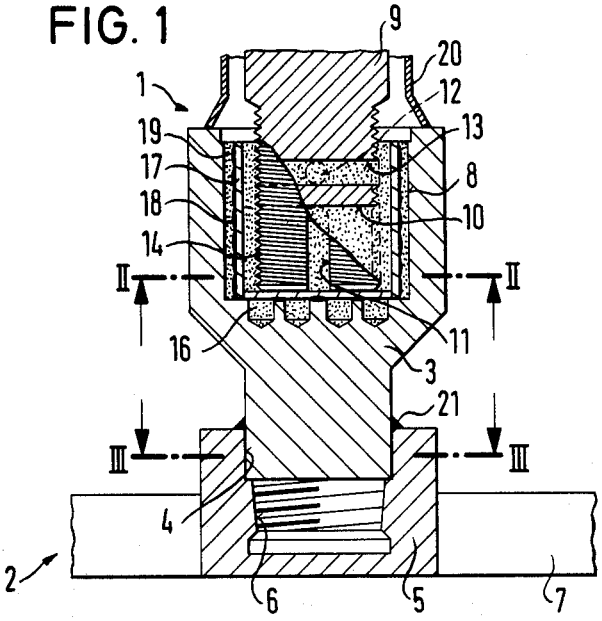
FIG. 1 shows an axial section through a first embodiment of current feeder according to the invention, installed in a conventional anode.

The current feeder 1 has a substantially square connection element 3 on its lower end which is formed of the same valve metal as the anode 2, thus for example of titanium. In order that the anode can be inserted, the lower end of the connection element 3 is processed to provide a narrower right angle which is inserted into a radial through-groove 4 on the upper side of a conventional connection bushing 5 of the star distributor of the anode. This groove is provided in essence through a special conical threaded bore 6 which serves for direct screwing in of a current feeder stud of old construction. On the connection bushing 5 of the anode are arranged radially directed current distribution rails 7 which characterise the star like construction of the distributor.

The connection element 3 has a receiving bore 8 inserted from above in which the lower end of a current feeder stud 9 engages, which is preferably formed of copper and extends substantially up to the base of the bore.

At the lower end of the current feeder stud 9 are arranged two perpendicularly disposed open-ended slots 10 and 11. Above these are provided two radial through-bores 12 and 13. Finally, the lower end of the current feeder stud has a profiled configuration 14 on its wall surface which can be formed for example of thread grooves.

The receiving bore 8 has uniformly distributed grooves 15 (FIG. 2) on its external periphery while small blind holes 16 are inserted in the base thereof. In the receiving bore 8 is moreover inserted a sleeve-like contact structure 17 abutting the inner surface of the receiving bore. The contact structure 17 is secured via welds 18 to this inner surface. The hollow chambers which are present in the connection zone between the bushing 3 and current feeder stud 9 are filled with an intermediate core 19 of casting metal. During introduction of the casting metal, this penetrates into all hollow spaces such as grooves 10 and 11 and bores 12 and 13 in the current feeder stud 9 and grooves 15 and bores 16 of the connection element 3 and thread grooves 14 as well as into the intermediate spaces of the contact structure 17. As a result, these three parts are intimately connected together.

The current feeder stud 9 is surrounded in the usual manner with valve metal cladding 20 which is welded with valve metal onto the upwardly facing end surface of the connection element 3. Likewise, the connection element 3 is secured in the connection bushing 5 adjacent the electrode by means of valve metal welding 21.

Figure 2:
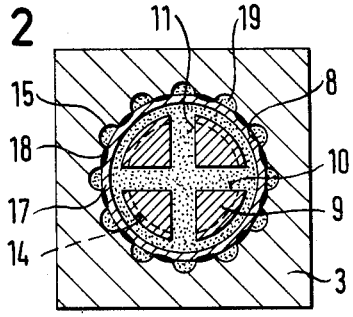
FIG. 2 shows a section along the line II—II of FIG. 1, illustrating the reception of the current feeder stud in the connection element.

FIG. 2 shows both the rectangular cross sectional shape of the connection element 3 and also the perpendicularly extending slots 10 and 11 and the concentric arrangement of the current feeder stud 9 and the contact structure 17 in the receiving bore 8 with their peripheral grooves 15.

Figure 3:
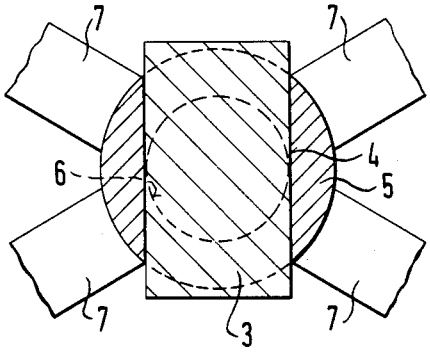
FIG. 3 shows a section along the line III—III illustrating the arrangement of the connection element in a conventional anode.

FIG. 3 shows, as already described, the mode of insertion of the connection element 3, narrowed at its lower end, into the star distributor with the connection bushing 5 having a threaded bore 6 and the arrangement of the current distribution rails 7.

Figure 4:
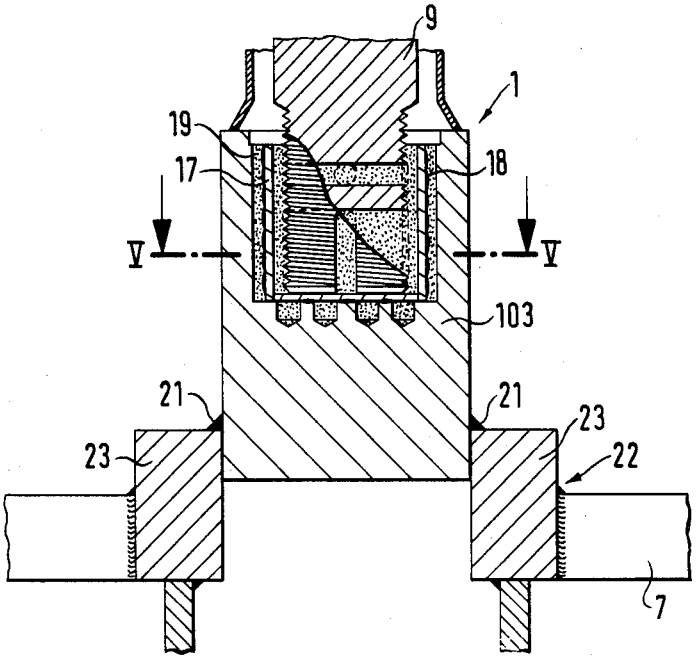
FIG. 4 shows an axial section through a current feeder according to FIG. 1 installed in a newly conceived anode with a star distributor.
Figure 5:
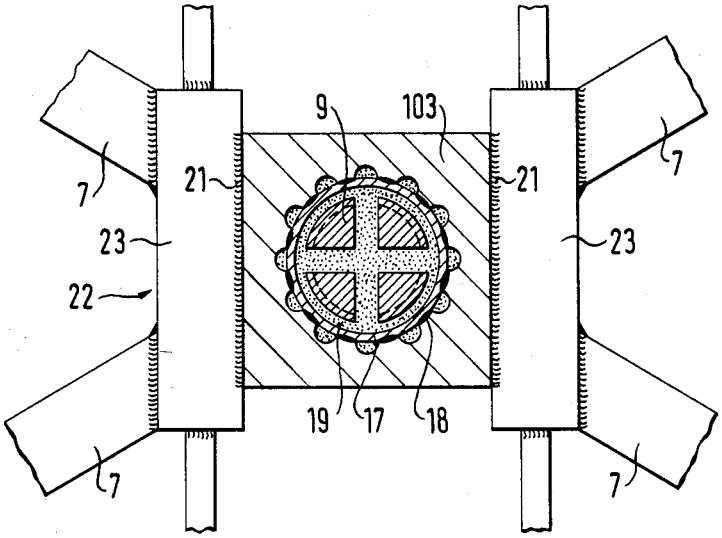
FIG. 5 shows a section along the line V—V of FIG. 4 with the arrangement of the connection element in the anode with star distributor.

From FIGS. 4 and 5 may be seen a similarly square connection element 103 of the current feeder according to the invention. It may be recognised that in the newly conceived anode here illustrated, the current distribution structure is differently configured. It is true that this likewise has a substantially star shaped construction similar to the conventional anode 2 illustrated in FIGS. 1 and 3. However, instead of a central connection bushing 5 there are provided two connection members 23 on oppositely lying sides of the connection element 103 and welded to the current distribution rails, the connection element 103 being in turn welded to these connection members 23.

Figure 6:
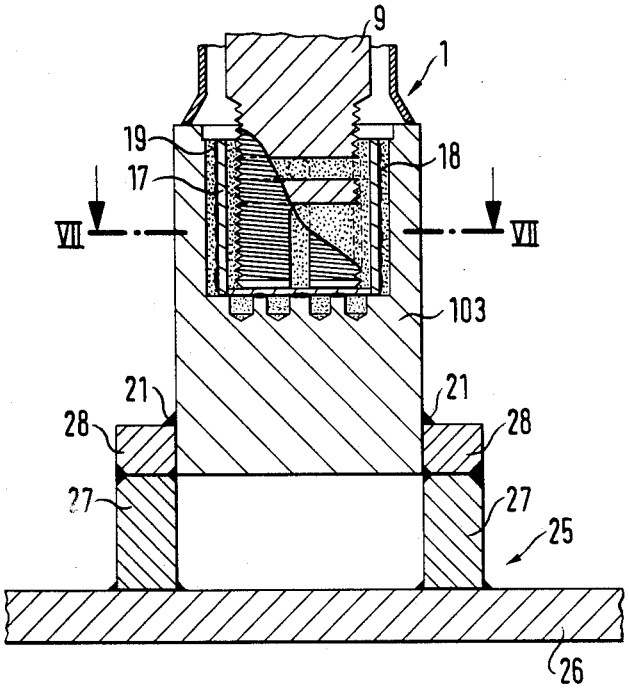
FIG. 6 shows an axial section through an electrode according to FIG. 1 in the arrangement for newly developed anodes with parallel distributor for large length/width relationship.
Figure 7:
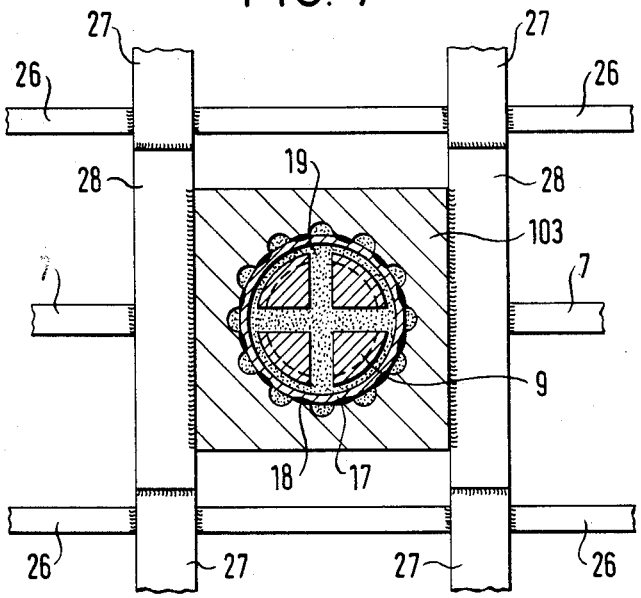
FIG. 7 shows a section along the line VII—VII of FIG. 6 illustrating the arrangement of the connection element with mutually parallel upper current distribution rails and connection members.

In FIGS. 6 and 7, is illustrated the arrangement of the current feeder of an electrode according to the invention in a further new anode whose length to width ratio is sufficiently large that a star shaped arrangement of the current distributor, such as in the exemplary embodiment of FIGS. 4 and 5, is no longer practical. The current distributor construction in this electrode is formed of lower horizontal current distribution rails 26 on whose lower side the anode construction forming the active surface is arranged and on whose upper side rectangular upper current feeder rails 27 are welded. On to these upper current feeder rails 27 are in turn welded connection members 28 which are shorter than the rails 27. Between the substantially mutually parallel connection members 28 is inserted the rectangular connection element 103 which is secured via easily breakable weld points 21.

Figure 8:
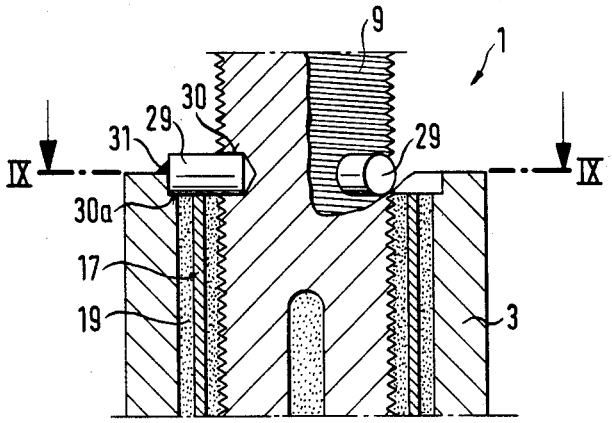
FIG. 8 shows an axial section through a current feeder according to the invention having a first embodiment of a so-called positioning and locking arrangement.
Figure 9:
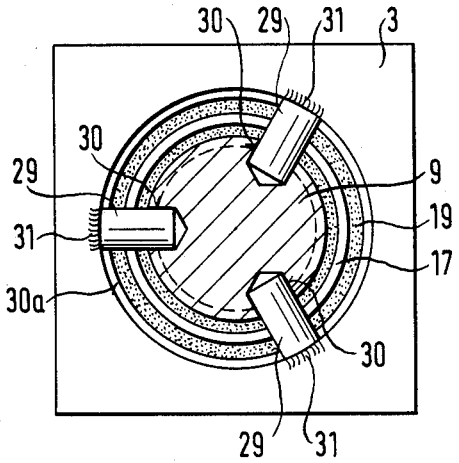
FIG. 9 shows a section along the line IX—IX through the arrangement of FIG. 8.

FIGS. 8 and 9 show a first exemplary embodiment of a positioning and locking arrangement between the current feeder stud 9 of the current feeder and the connection element 3. This arrangement serves primarily to ensure secure fixing of the electrode on to the current feeder in the event of a short circuit or quasi short circuit in operation of the electrode even in the event of overheating of the metal of the intermediate core 19. According to this exemplary embodiment, the anode consists of a plurality of valve metal bolts 29 which are inserted into radial blind holes 30 of the core 9 of the current feeder and which lie on a step 30*a* on the upper end of the connection element 3. For securing the bolts 29, these are welded to the connection element 3 via weld points 31.

Figure 10:
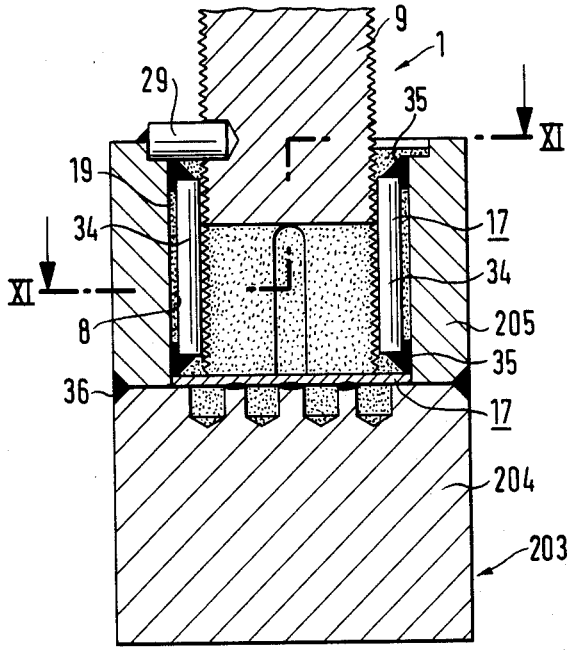
FIG. 10 shows an axial section through a current feeder according to the invention with the positioning and locking arrangement and a modification of the connection element.
Figure 11:
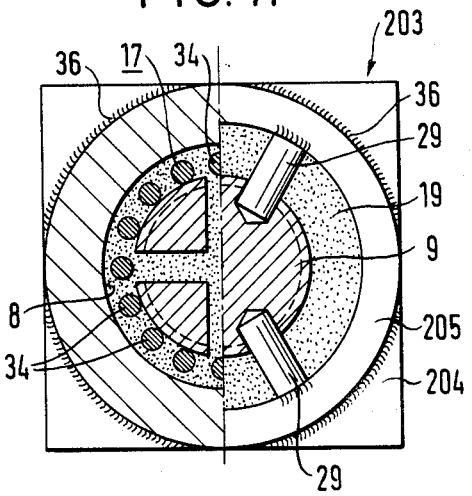
FIG. 11 shows a section XI—XI of FIG. 10.

In FIGS. 10 and 11 may be seen an identical positioning and locking arrangement with bolts 29. This exemplary embodiment is distinguished from the preceding firstly in that the connection element 203 consists of two components, that is to say of a lower rectangular component 204 and an upper component 205 axially adjoining this and having a cylindrical wall surface. A further modification may be seen in that the contact structure 17 consists of rods 34 of valve metal, for example titanium, which surround the lower end of the current distribution stud 9 in a ring shape. In order to securely fix these rods 34 into the receiving bore 8 of the upper component 205 of the connection element 203, they are connected on their respective ends via weld points 35 to the cylindrical wall surface of the receiving bore 8. With reference to the end of the current feeder stud 9 the contact structure 17 consists secondly of a circularly cut expanded grid. After welding of the rods 34 into the receiving bore 8 in the upper component 205 of the connection element 203, this upper component 205 and the lower component 204 are connected together at the weld point 36.

For fixing the rods 34 into the receiving bore 8, these can also be welded at their respective ends by means of a ring of titanium, which can then be welded to the internal wall surface of the receiving bore 8.

Figure 12:
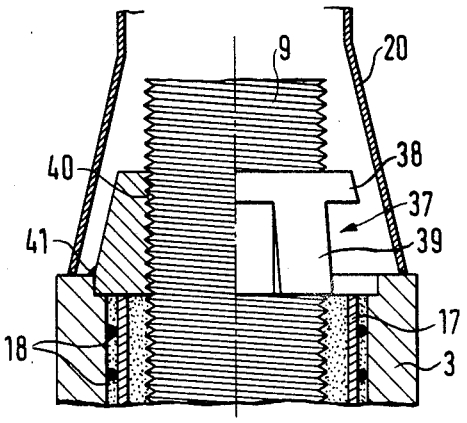
FIG. 12 shows an axial section through a current feeder according to the invention with a second embodiment of the positioning and locking arrangement.
Figure 13:
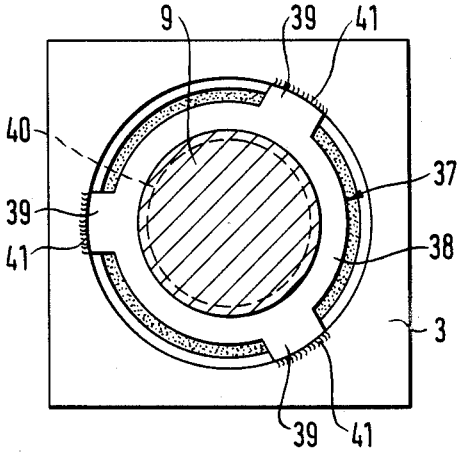
FIG. 13 shows an axial plan view of the arrangement according to FIG. 12.

FIGS. 12 and 13 show a second exemplary embodiment of a positioning and locking arrangement between the current feeder stud 9 and the connection element 3. This consists of a sleeve 37 which is constructed for example as a cast component and which consists of an annular component 38 from which extend a number, for example 3, of lugs 39 uniformly distributed round the periphery and extending substantially axially but also slightly radially outwards. While the annular component 38 of the sleeve 37 is mounted for axial displacement by means of a thread 40 on the current feeder stud 9 for adjustment between the current feeder stud 9 and the connection element 3, the lower ends of the lugs 39 are supported on the upper end of the connection element 3 and are there secured to this via weld points 41.

Figure 14:
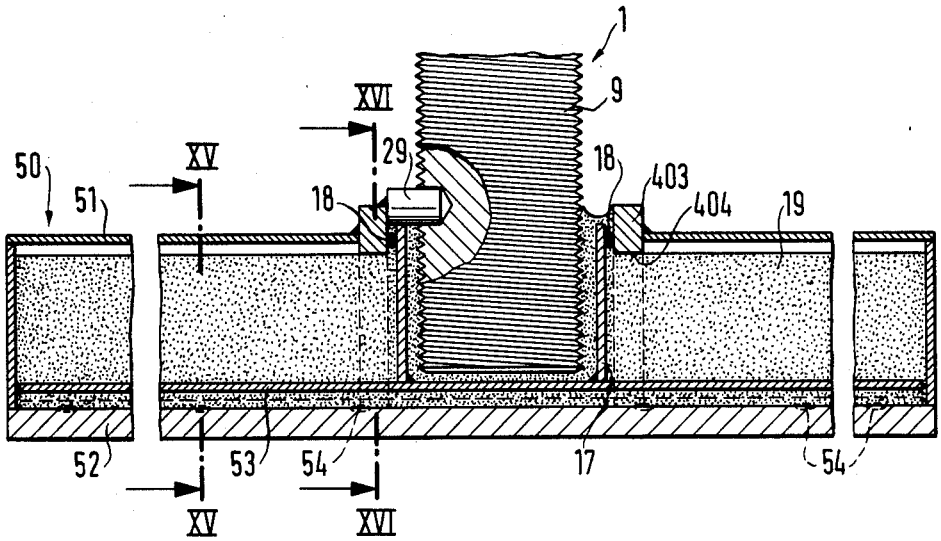
FIG. 14 shows a vertical longitudinal section through a newly configured current distributor with inserted current feeder.
Figure 15:
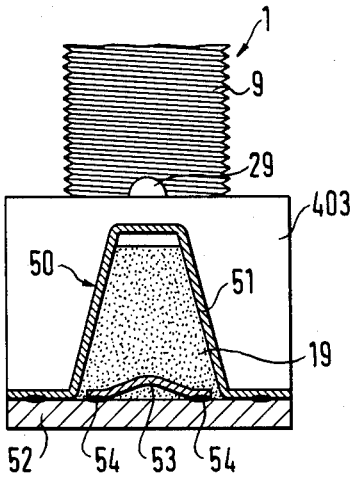
FIG. 15 shows a section XV—XV according to FIG. 14.
Figure 16:
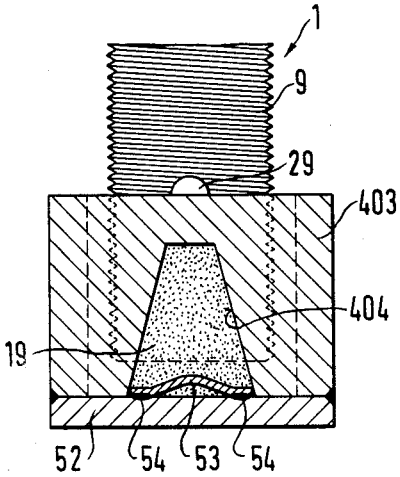
FIG. 16 shows a section XVI—XVI according to FIG. 14.

FIGS. 14 to 16 show a first exemplary embodiment of a horizontal current distribution system with integrated current feeder.

The current feeder 1 comprises according to the invention a substantially rectangular connection element 403 into which the lower end of the current feeder stud 9 is inserted and is secured by means of positioning and locking bolts 29. Furthermore, the contact structure 17 can be seen which is connected via weld points 18 to the inner wall surface of the connection element 403.

The connection element 403 is integrated into a newly constructed current distribution arrangement which is designated as a whole with reference 50. This current distributor 50 consists of a substantially trapezium shaped hollow profile which is formed from a correspondingly curved upper sheet 51 consisting of valve member, preferably titanium, and a lower plate 52 consisting of valve metal, preferably titanium, cooperating with the upper sheet to form a hollow profile. For receiving the connection element 403 in the hollow profile of the current distributor 50, the upper sheet 51 has a corresponding recess and the sheet 51 abuts with the thus formed end onto the outer surface of the connection element 403 and is welded thereto. On the inner side of the plate 52 extends a contact structure 53 formed for example as an expanded metal grid which is connected via weld points 54 to the plate 52. The lower end of the current feeder stud 9 ends either shortly above the contact structure 53 or lies on this. Furthermore, the contact structure 17 and the contact structure 53 can be connected, preferably via corresponding weld points.

Both the connection element 403 and also the current distributor 50 are filled with an intermediate cast metal core 19 formed of one of the said materials, so that a particularly good current transfer between the current feeder stud 9 and the current distributor 50 results. For this common casting, the connection element 403 has corresponding recesses 404 so that the connection element 403 and current distributor 50 communicate with each other.

Figure 17:
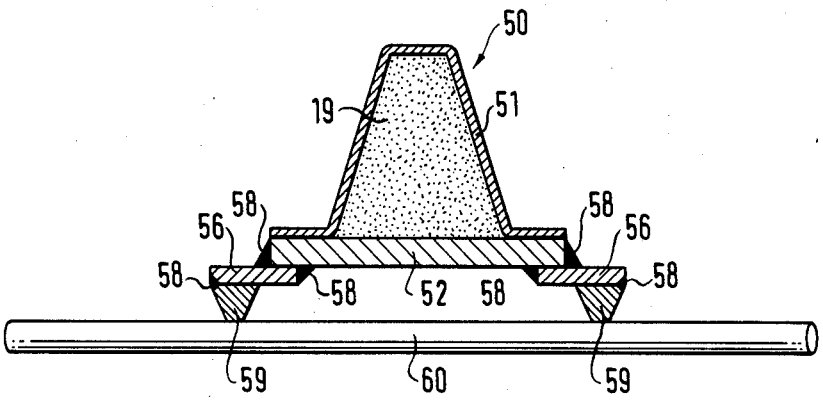
FIG. 17 shows a section through a current distributor slightly modified against the arrangement according to FIG. 14.
Figure 18:
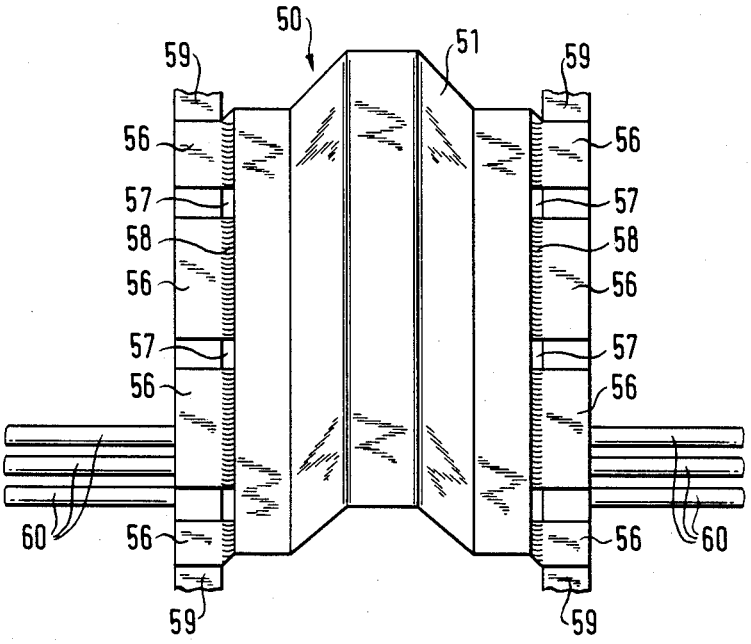
FIG. 18 shows a plan view of the current distributor according to FIG. 17.

FIGS. 17 and 18 show a current distributor 50 which is somewhat comparable with the Figures described in the foregoing and consists of a trapezium shaped sheet 51 and a plate 52.

On the lower side of the plate 52 of the current distributor 50 are welded horizontal cross-members 56 at weld points 58. Here, horizontal cross-members 56 have recesses 57 which function as gas release holes during use of the anode. On the cross-members 56 are welded connection members 59 likewise at weld points 58. On these in turn are arranged the active elements of the electrode, in the present case in the form of round rods 60. For recoating the active elements 60, the weld points 58 can easily be separated between the horizontal cross-members 56 and the connection members 59.

Figure 19:
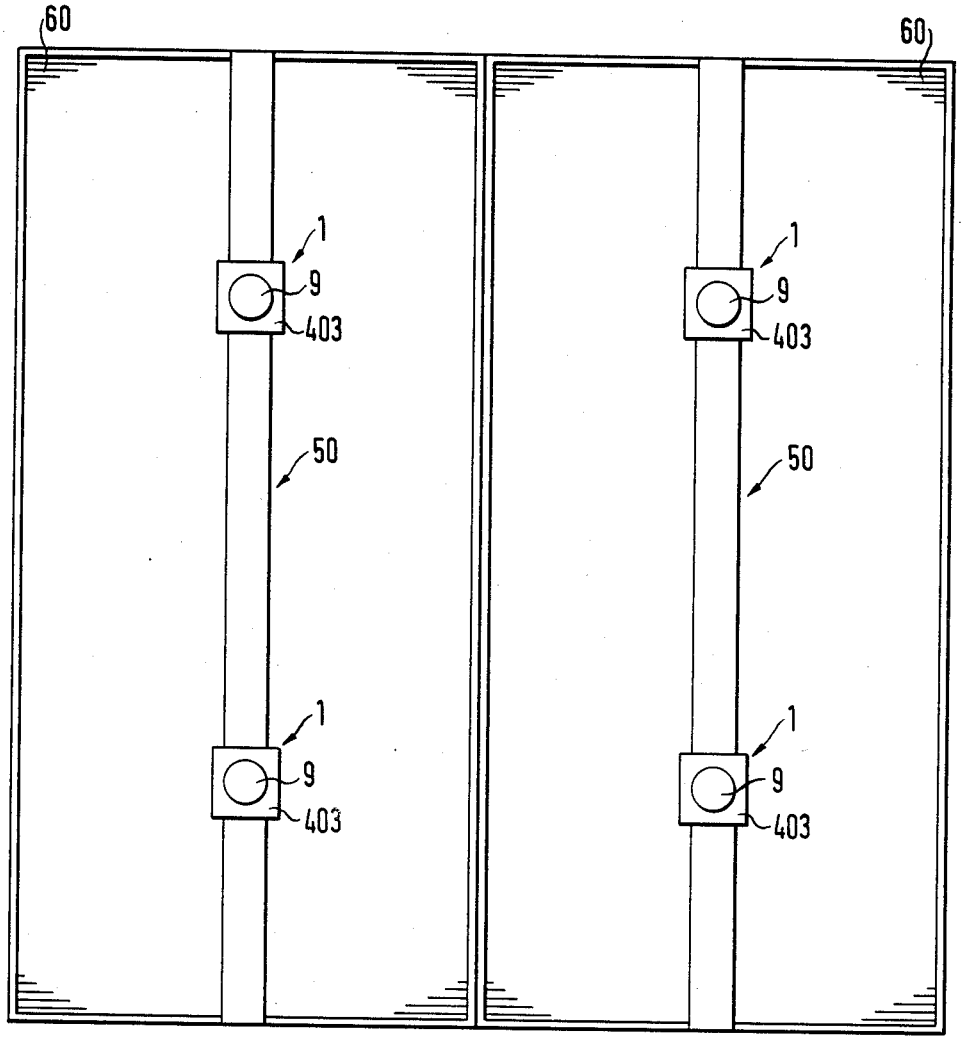
FIG. 19 shows a schematic plan view of a newly configured electrode with current feeder and current distributor.
Figure 20:
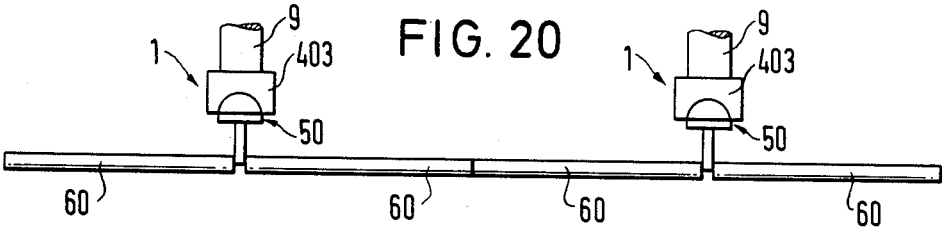
FIG. 20 shows a schematic side view of this electrode.

FIGS. 19 and 20 show schematic views of a newly conceived electrode with use of the described current feeders 1 and current distributor 50. Illustrated are the current feeder stud 9, its connection element 403, the current distributor 50 and the active elements 60 connected thereto, here in the form of rounded flat rods, which are assembled by means of outer boundary elements to form a type of grating.

Figure 21:
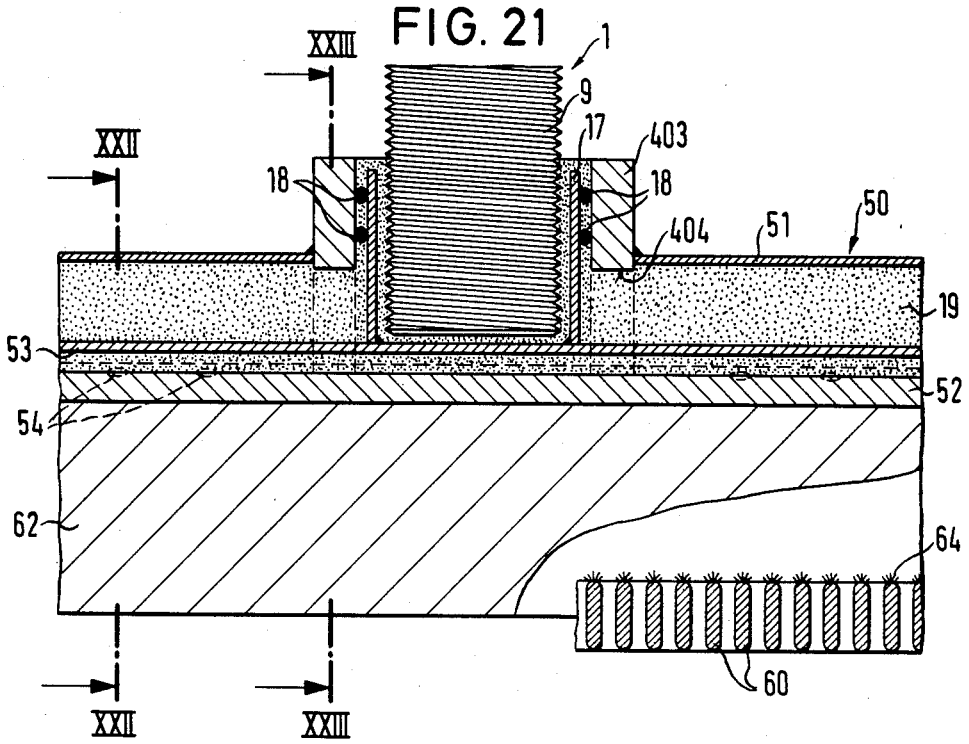
FIG. 21 shows a vertical longitudinal section through a current distributor of the electrode according to FIG. 19 with inserted current feeder.
Figure 22:
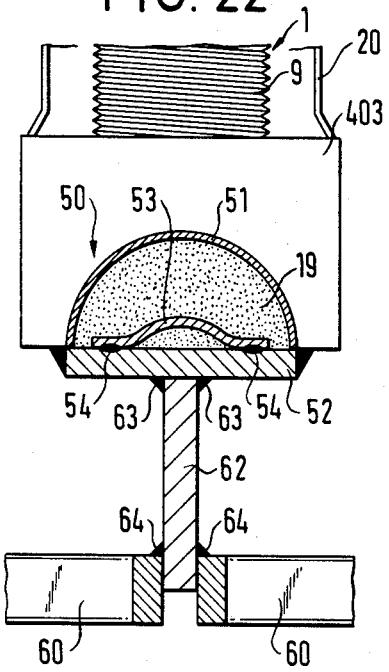
FIG. 22 shows a section XXII-XXII of FIG. 21.
Figure 23:
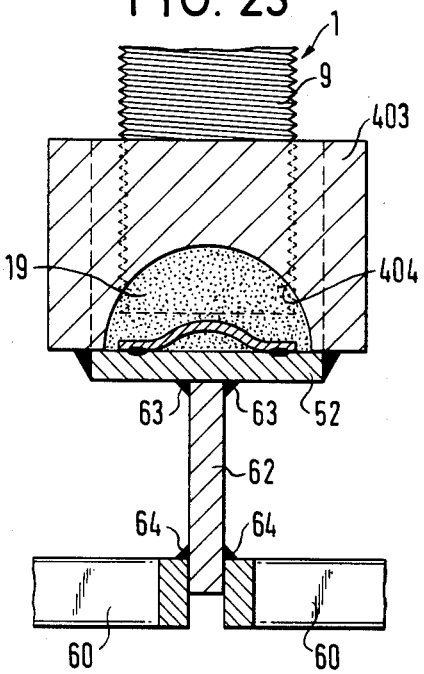
FIG. 23 shows a section XXIII-XXIII of FIG. 21.

The essential components of the electrode according to FIGS. 19 and 20 may be seen clearly from FIGS. 21 to 23.

Accordingly, the respective current distributor 50 is formed from the sheet 51, here curved in a semicircular form, and the plate 52. The construction of the connection elements 403 and their integration into the current distributor 50 is identical to the construction described in connection with FIGS. 14 to 16.

The active elements 60 consisting of rounded flat rods in the form of gratings are connected to the current distributor 50 by means of welding on the lower side of the plate 52 by means of welding a through-going web 62 onto the lower side of the plate 52 at weld points 63. On the lower end of this web 62 are mounted on both sides the active elements 60 in the form of grids at weld points 64. These weld points 64 need not represent weld seams extending over the length of the grid, but can be distributed in the form of spot welds. As a result, the respective weld positions 64 can be separated particularly easily in order to release the grating like active element 60 for example for turning or recoating and then they may be easily remounted on the web 62. For separating the weld points 64, for example by means of a separating machine, the web 62 has a corresponding recess so that sufficient space is provided for the separating machine.

Experiments have shown that known current feeders cast in Woods metal have a high voltage drop of about 200 mV after long installation, while the current feeders according to the invention a constant voltage drop of below about 15 mV with a current loading of about 0.8 to 2.5 kA per contact may be expected over a period of years.

The following data comparing a known anode with two anodes according to the invention can be achieved:

| | Anode according to DE-AS 2031525 | Anode according to FIGS. 14 to 18 | Anode according to FIGS. 19 to 23 |
|---|---|---|---|
| Dimensions | 690 × 790 mm | 690 × 790 mm | 800 × 800 mm |
| Weight of titanium | | | |
| Active part | 3.87 kg | 5.68 kg | 14.0 kg |
| Upper structure | 12.29 kg | 5.60 kg | 5.0 kg |
| Total | 16.16 kg | 11.28 kg | 19.0 kg |
| Weight of zinc | — | 5.05 kg | 5.28 kg |
| Voltage drop of the entire construction at 12.5 kA/m$^2$ | 93 mV | 57 mV | 45 mV |

We claim:

1. A current feeder for metal electrodes for electrochemical processes and in which each electrode has associated therewith current distribution elements, said current feeder comprising;

a connection element of valve metal having a receiving bore and a base, means for securing the base of the connection element to the current distribution elements of the electrode, a current feeder stud having a base positioned in the receiving bore of the connection element and dimensioned relative to the receiving bore to provide an intermediate space between the current feeder stud and the bore of the connection element, a substantially tubular contact structure of valve metal disposed in the intermediate space between the current feeder stud and the bore of the connection element, means for securing said contact structure to said connection element at said receiving bore, and a poured metal that fills the receiving bore and forms an intermediate metal core for fixing the base of the current feeder stud.

2. Current feeder according to claim 1 wherein the contact structure is an open construction having surfaces orientated in a plurality of directions.

3. Current feeder according to claim 2 wherein the contact structure is formed of a sleeve of at least one of expanded metal, wire netting, apertured sheet, and bars.

4. Current feeder according to claim 3 wherein the contact structure is arranged substantially parallel to the direction of current flow.

5. Current feeder according to claim 1 wherein the contact structure is provided with a contact coating.

6. Current feeder according to claim 1 wherein the intermediate core consists of a metal whose melting point lies at least 500° C. below that of the metal of the connection element and has a substantially higher electrical conductivity than the metal of the connection element.

7. Current feeder according to claim 1 wherein the receiving bore of the connection element is provided substantially over its entire length with uniformly distributed axial grooves on its periphery.

8. Current feeder according to claim 1 wherein in the base of the receiving bore of the connection element are arranged relatively uniformly distributed short axial blind holes.

9. Current feeder according to claim 1 wherein the end of the current feeder stud extending into the receiving bore is provided with at least one radial through-slot.

10. Current feeder according to claim 9 wherein two substantially perpendicularly arranged radial slots are provided.

11. Current feeder according to claim 1 wherein in the lower end of the current feeder stud extending into the receiving bore at least one radial through hole is provided.

12. Current feeder according to claim 1 wherein the lower end of the current feeder stud extending into the receiving bore has a peripheral profiled formation.

13. Current feeder according to claim 1 wherein between the current feeder stud and the connection element a positioning and locating arrangement is provided.

14. Current feeder according to claim 13 wherein the positioning and locating arrangement consists of a plurality of valve metal bolts which engage into radial blind bores in the current feeder stud and lie at the upper end of the connection element.

15. Current feeder according to claim 14 wherein the valve metal bolts are welded to the connection element.

16. Current feeder according to claim 13 wherein a sleeve is secured to the current feeder stud and is connected to the connection element.

17. Current feeder according to claim 16 wherein the sleeve is screwed onto the current feeder stud.

18. Current feeder according to claim 16 wherein the sleeve is welded to the connection element.

19. Current feeder according to claim 1 wherein the connecting element is constructed as a cylindrical bushing with a central receiving bore which is weldable to a connection bushing adjacent the electrode.

20. Current feeder according to claim 1 wherein the connection element is constructed as a rectangular block which can be inserted between two parallel connection members adjacent the electrode and can be welded thereto.

21. Current feeder according to claim 1 wherein the connection element consists of two separate components perpendicular to the axial direction of the receiving bore, the separation plane of which components extends in the region of the base of the receiving bore, and which are welded longitudinally of the receiving bore after insertion of the contact structure into the receiving bore.

22. Current feeder according to claim 1 wherein a current distributor of the electrode is constructed as a hollow profile which is filled with a casting metal and into which a contact structure is embedded which is connected to the hollow profile via a plurality of weld points, and said current feeder stud is connected to said current distributor in such manner that its connection element is inserted into a recess of the hollow profile, the receiving bore of the coupling element being connected to the inner wall of the hollow profile and both being filled with cast metal.

23. Current feeder according to claim 22 wherein the current feeder stud is connected at its lower end to the contact structure in the hollow profile.

24. Current feeder according to claim 22 wherein the hollow profile is connected via an easily separable weld construction to the relevant active part of the electrode.

25. A current feeder according to claim 1 wherein said means for securing said contact structure to said connection element at said receiving bore comprises weld means.

26. A current feeder according to claim 25 wherein said weld means comprises a plurality of weld points disposed about said contact structure.

27. A current feeder according to claim 26 wherein said current element has a plurality of longitudinally disposed slots extending circumferentially about the receiving bore and said plurality of weld points are formed between the contact structure and locations on the connection element between the elongated slots of the connection element.

28. A current feeder according to claim 1 wherein said poured metal forming said intermediate metal core substantially encases said contact structure.

* * * * *